United States Patent [19]

Richmond

[11] 4,403,449

[45] Sep. 13, 1983

[54] GATE-OPENING AND CLOSING APPARATUS AND METHOD

[76] Inventor: Moscow K. Richmond, 2819 Butler Ave., Los Angeles, Calif. 90066

[21] Appl. No.: 406,720

[22] Filed: Aug. 9, 1982

Related U.S. Application Data

[63] Continuation of Ser. No. 126,717, Mar. 3, 1980, abandoned.

[51] Int. Cl.[3] ..... E05F 11/24

[52] U.S. Cl. ..... 49/340; 49/139; 403/323

[58] Field of Search ..... 49/280, 340, 341, 343, 49/345, 139, 140; 403/323, 319, 350, 356; 318/382

[56] References Cited

U.S. PATENT DOCUMENTS

| | | | |
|---|---|---|---|
| 2,582,666 | 1/1952 | Young | 49/280 |
| 3,380,759 | 4/1968 | Engelmann | 403/323 X |
| 3,429,074 | 2/1969 | Horton | 49/30 X |
| 3,874,117 | 4/1975 | Boehm | 49/30 X |
| 4,084,661 | 4/1978 | Quan et al. | 187/29 R |
| 4,159,599 | 7/1979 | Richmond | 49/363 |
| 4,234,833 | 11/1980 | Barrett | 318/282 |

FOREIGN PATENT DOCUMENTS

| | | | |
|---|---|---|---|
| 7806571 | 9/1979 | France | 49/340 |

*Primary Examiner*—Kenneth Downey
*Attorney, Agent, of Firm*—Robert J. Schaap

[57] ABSTRACT

An apparatus for shifting a gate from a closed position to an opened position and from the open position to the closed position with respect to an access opening. The apparatus comprises a housing with a motor in the housing, as for example, an electric motor. A drive shaft extends outwardly from the housing and is operable by the motor by means of a drive mechanism. A drive arm is connected to the outer end of the drive shaft, outwardly of the housing, and is rotatable thereby. The drive arm is designed to permit a lever arm or a lever arm assembly to be coupled thereto and which is also capable of being coupled to a gate for moving the same between the opened and closed positions. Further, the apparatus comprises a shaft coupling mechanism operatively associated with the drive arm for coupling the drive arm to the drive shaft so that the drive arm is rotatable with the drive shaft when the motor is operated. In addition, a disconnect mechanism, preferably a manually operable disconnect mechanism, is associated with the drive arm, and is operatively connected to the coupling mechanism for disengaging the drive shaft from the drive arm. This permits the drive arm to rotate independently of the drive shaft in emergency situations, as for example, in cases of power failure where the motor cannot be operated. The drive mechanism is designed with a worm and worm gear construction so that one cannot unauthorizedly attempt to rotate the drive arm without completing disengaging the drive arm from the drive shaft.

46 Claims, 13 Drawing Figures

GATE-OPENING AND CLOSING APPARATUS AND METHOD

RELATED APPLICATION

This application is a continuation of U.S. application Ser. No. 126,717 filed Mar. 3, 1980, for Gate Opening and Closing Apparatus (now abandoned).

BACKGROUND OF THE INVENTION

1. Field of the Invention

This invention relates in general to certain new and useful improvements in improved gate-opening and closing apparatus and, more particularly, to gate-opening and closing apparatus and the method therefor which shifts a gate between an open and a closed position and which permits authorized manual activation thereof in the event of a failure of powered operation thereof.

2. Brief Description of the Prior Art

In recent years, there have been a number of gate opening and closing assemblies and particularly, automatic type opening and closing assemblies. These gate assemblies have received increasing prominence in many commercial applications. There are several types of gates which are moved from a closed position to an open position in order to provide access and back to a closed position in order to provide a type of security. One type of gate is a gate which is slidable on a trackway, or other mechanism, for movement in a linear direction. This type of gate shifts from an open position in a linear path to a closed position in order to block the access opening. Other types of gates have one vertical side portion thereof hingedly mounted so that the other vertical side portion is swingable away from a stationary structure to an open position and back toward the stationary structure to a closed position.

As indicated previously, the automatic gate openers, in particular, have received increased prominence in recent years. These automatic gate openers may operate on the basis of a remote control mechanism such that a party desiring to open or close the gate does not have to physically engage the gate. For example, the gate opening and closing apparatus may use a radio transmitter and receiver system, such that a radio transmitter, when actuated, will generate a particular frequency signal which is sensed by the receiver to automatically operate the gate or door in order to open the same or close the same.

These radio transmitter and receiver systems have been used with various types of gates. Moreover, they have also been used with gates having one vertical side wall hingedly mounted and the other vertical side wall of which moves with respect to the stationary structure.

Notwithstanding, various forms of gate operating mechanisms, as for example, simple electrical switches, are used in order to shift gates from the closed to the opened positions and from the opened to the closed positions with respect to an access opening.

In the case of the so-called "swing gates", that is gates which are hingedly mounted on one vertical margin, there has not been any effective mechanism for efficiently shifting the gate, particularly when the gate had a large overall length resulting from a rather large swing movement. One of the principal problems encountered with these types of gates is that the gate must be locked when it reaches the closed position. The lever arms or other drive mechanisms, which were used to shift the gate between the closed and open positions, could preferably be designed to provide some type of locking action. Notwithstanding, there were many occasions in which the gate could be forced open against the action of the gate opening and closing assembly by causing one or more components in the drive section to slip.

In swing gate opening and closing assemblies, there was not any effective means for overriding the mechanism itself in the event of a temporary emergency condition such as a power failure. In the case of an electrical power failure, the motor could not be operated to open and close the gate. Consequently, there needed to be an effective override means which permitted the gate to be opened or closed by manual operation, but which did not compromise the integrity of the mechanism when the power was available.

OBJECTS OF THE INVENTION

It is, therefore, a primary object of the present invention to provide an improved gate opening and closing apparatus which is designed to permit a motive mechanism to open and close a gate in response to energization thereof and which also permits manual overriding in the event of a power failure, but which is nevertheless highly efficient to prevent unauthorized opening of the gate.

It is another object of the present invention to provide an apparatus of the type stated which is highly efficient in its operation and requires a minimum amount of space in order to fully operate a gate to produce a shiftable movement thereof.

It is further object of the present invention to provide an apparatus of the type stated in which a motive mechanism drives a rotatable drive shaft and a drive arm is connected to the outer end of the drive shaft for ultimate connection to a gate and which drive arm permits both connection of a lever arm assembly and includes a manually operable disconnect means.

It is also an object of the present invention to provide an apparatus of the type stated which can be manufactured at a relatively low cost and which is nevertheless highly efficient in its operation.

It is still another object of the present invention to provide an apparatus which utilizes an electrically operable counting mechanism for determining the amount of swinging movement of the gate between the open and closed positions and a control circuit for thereafter controlling the movement between the open and closed positions.

It is another salient object of the present invention to provide a method for opening and closing a gate by utilizing an apparatus which permits opening and closing pursuant to energization of a motive means, and which also permits a convenient manual override thereof.

With the above and other objects in view, my invention resides in the novel features of form, construction, arrangement and combination of parts presently described and pointed out in the claims.

BRIEF SUMMARY OF THE DISCLOSURE

The invention relates to an apparatus for shifting a gate from a closed position with respect to an access opening to an open position and from the open position to the closed position. In one embodiment, the gate opening and closing apparatus is preferably adapted for use with a so-called "swing gate", that is one which is hingedly mounted for swinging movement about one of its vertical edges as hereinafter described in more detail.

The apparatus generally comprises a housing means along with a motive means associated with the housing means and preferably located in the housing means. The motive means also preferably adopts the form of an electric motor. A drive shaft extends from the housing and is operable by the motive means so as to be rotatable thereby. A drive arm is operatively connected to the outer end of the drive shaft and is rotatable therewith such that the drive arm is located externally of the housing. The drive arm is provided with means to permit a coupling to a gate for shifting the same from the closed to the open position and from the open to the closed position.

In one embodiment of the invention, the means which permits the coupling to a gate may adopt the form of a lever arm assembly comprised of at least one lever arm, and preferably a plurality of lever arms such that one of the lever arms may be connected to the drive arm and the other of the lever arms connected to the gate itself.

The apparatus of the invention is also provided with a shaft coupling means associated with the drive arm for coupling the drive arm to the drive shaft so that the drive arm is rotatable with the drive shaft when the motive means is actuated. Further, the apparatus comprises a disconnect means, and preferably, a manually operable disconnect means which is associated with the drive arm. This disconnect means is operably connected to the shaft coupling means for disengaging the shaft from the drive arm to permit the drive arm to rotate independently of the drive shaft. This is highly desirable in order to permit the drive arm to be rotated manually in order to thereby open and close the gate in the event of a power failure such that the motive means could not be energized.

In another aspect of the invention, the apparatus is provided with a clutch operatively interposed between the motive means and the drive shaft to permit some slight degree of slippage between the drive shaft and the motive means as hereinafter described in more detail.

In another aspect of the invention, the shaft coupling means comprises a bore in the arm and a disc, such as a sleeve, which is locatable in the bore. The disc or sleeve has an opening to receive the drive shaft in order to rotate the arm. The disconnect means is manually operable as aforesaid and comprises a locking element adapted to be manually shiftable between a slot in the arm and the disc to thereby lock one another together in order to permit rotation together. The locking element is also adapted to be manually shifted out of the slot in the disc to permit the arm to rotate independently of the drive shaft.

The drive mechanism itself includes an intermediate shaft along with a coupling means for connecting the drive shaft and the motive means. A worm gear is operatively mounted on the drive shaft, and a worm is mounted on the intermediate shaft in meshing engagement with the worm gear. In this way, a rotational force imposed on the drive shaft will not unauthorizedly cause rotation of the intermediate shaft and hence the motive means and this will help to avoid unauthorized opening of the gate.

In another embodiment of the invention, a light operable sensory means for effectively counting the number of rotations of the drive shaft is also provided. These rotations of the drive shaft or some other shaft is generally fixed in a given distance of movement and hence effectively designate the distance between the open and closed positions. Further, the apparatus comprises a control means operatively connected to the light operable sensory means in order to control the movement of the gate in response to the counted number of rotations of the drive shaft. The light operable sensory means may comprise a disc associated with and preferably mounted on and rotatable with the drive shaft. Further, a light passage may be created with respect to a light sensitive element such as a photocell through light passage areas in the disc.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but is is to be understood that such detailed descriptions are not to be taken in a limiting sense.

BRIEF DESCRIPTION OF THE DRAWINGS

Figure 1:
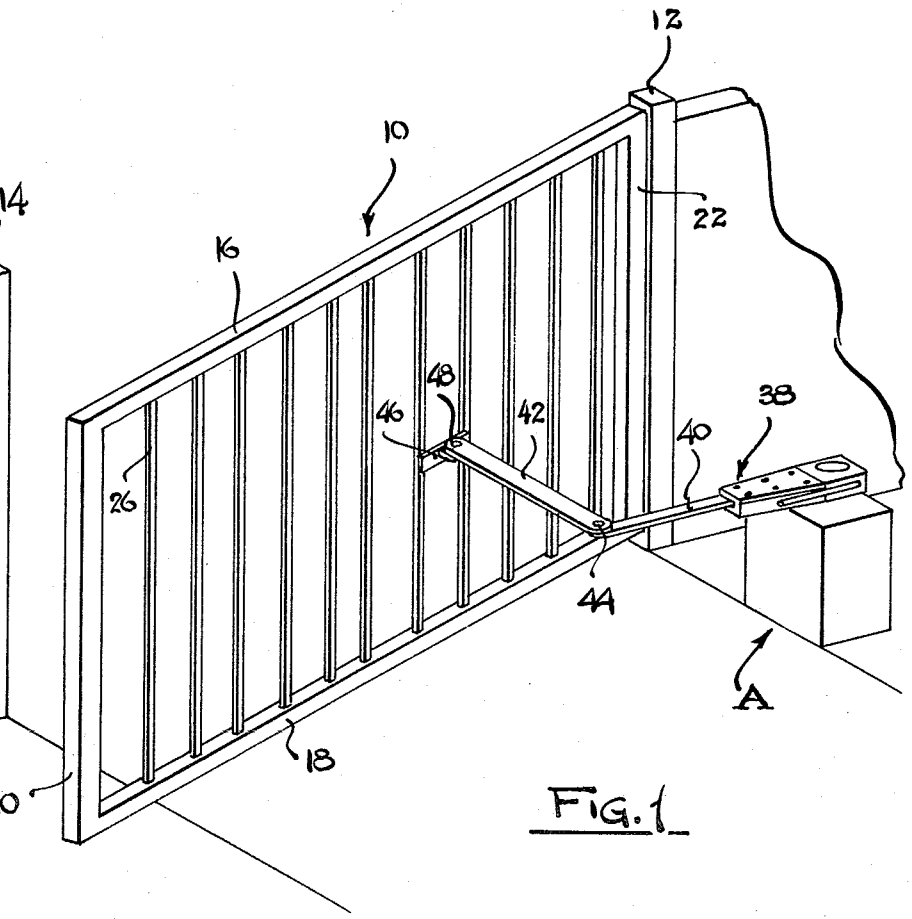
Figure 2:
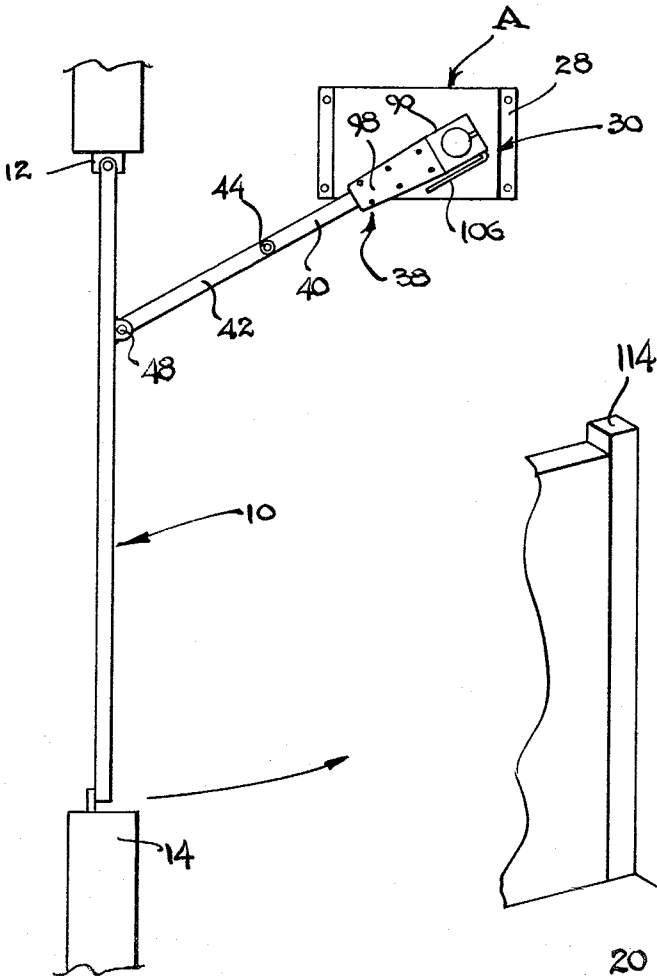
Figure 3:
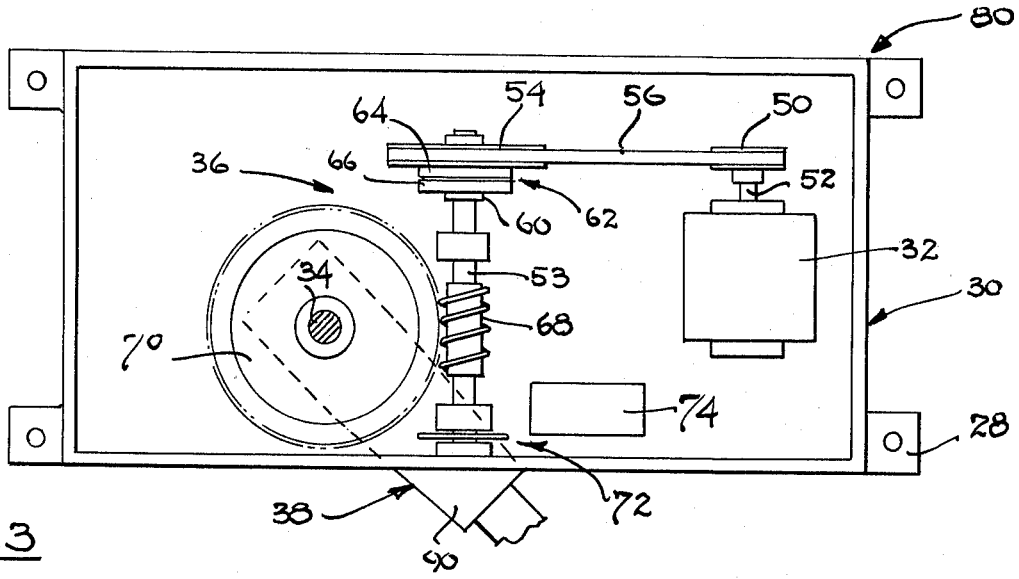
Figure 4A:
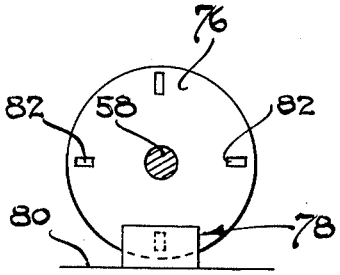
Figure 4B:
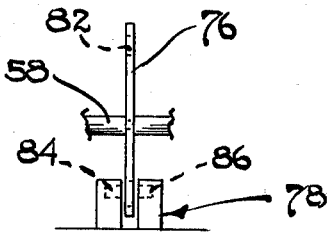
Figure 5:
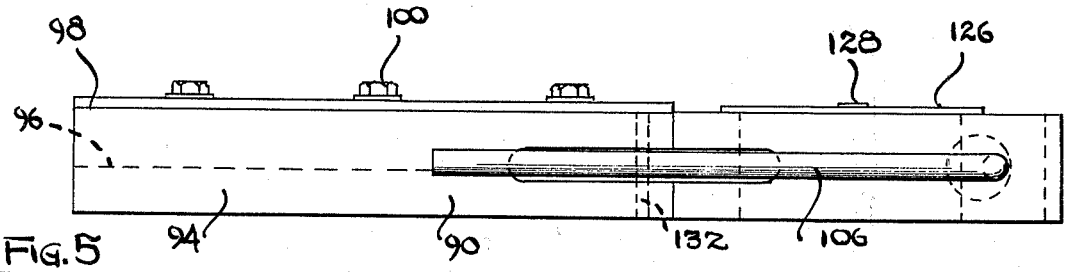
Figure 6:
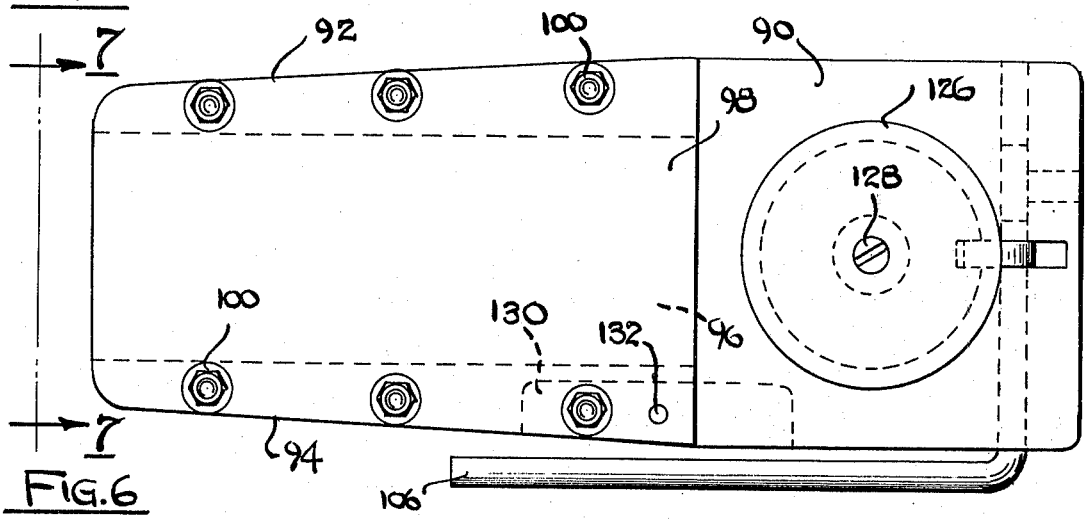
Figure 8:
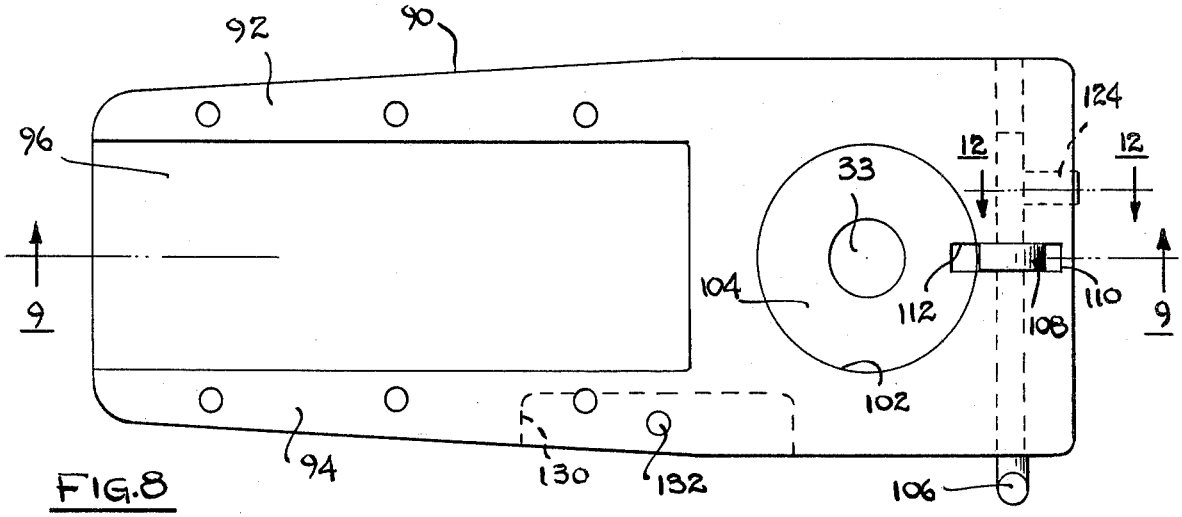
Figure 9:
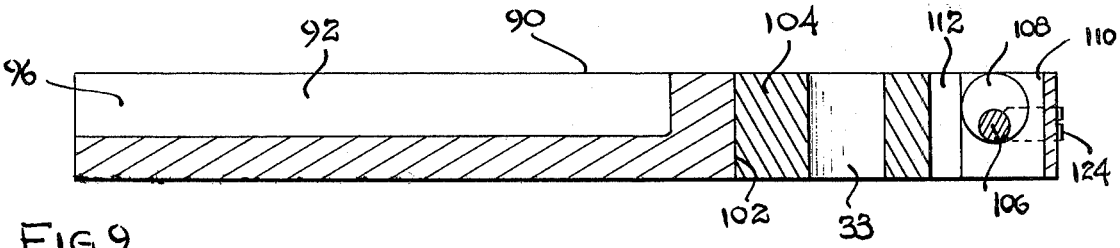
Figure 7:
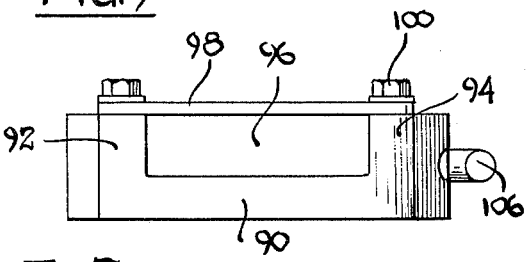
Figure 10:
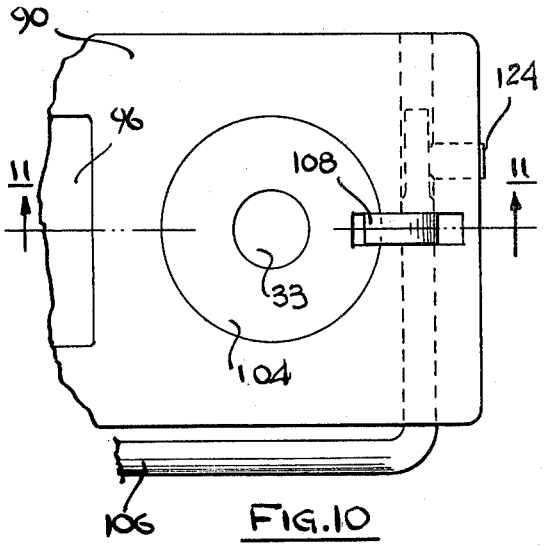
Figure 12:
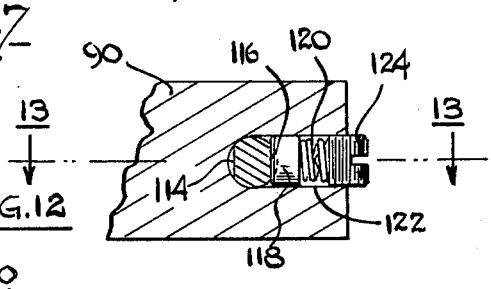
Figure 13:
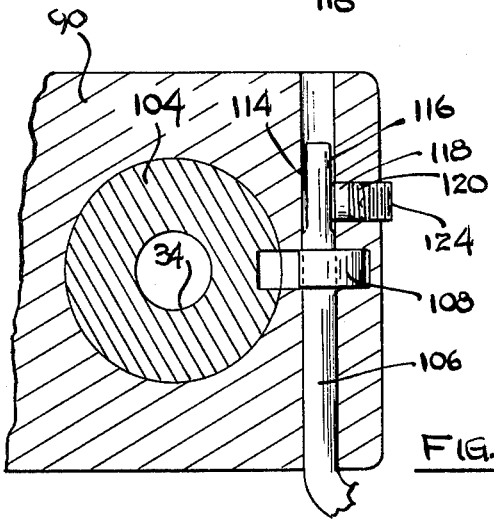
Figure 11:
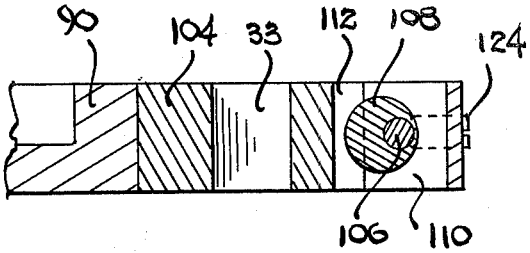

Having thus described the invention in general terms, reference will now be made to the accompanying drawings (three sheets) in which:

FIG. 1 is a perspective view of the gate opening and closing apparatus constructed in accordance with and embodying the present invention and being shown as connected to a swingable gate;

FIG. 2 is a top plan view of the assembly of the gate and the apparatus of the present invention as shown in FIG. 1;

FIG. 3 is a plan view of the gate opening and closing apparatus with one of the cover panels of the housing removed;

FIG. 4A is a side elevational view of a counting mechanism forming part of the gate opening and closing apparatus;

FIG. 4B is an end elevational view of the counting mechanism of FIG. 4A;

FIG. 5 is a side elevational view of the drive arm mechanism forming part of the apparatus of the present invention;

FIG. 6 is a top plan view of the drive arm mechanism of FIG. 5;

FIG. 7 is an end elevational view of the drive arm mechanism, taken essentially along lines 7—7 of FIG. 6;

FIG. 8 is a top plan view of the drive arm mechanism of FIG. 6 showing one of the cover plates thereof removed to show an interior portion of the drive arm mechanism;

FIG. 9 is a vertical sectional view taken along line 9—9 of FIG. 8;

FIG. 10 is a fragmentary top plan view showing a portion of the drive arm mechanism in FIG. 8; and FIG. 11 is a vertical sectional view taken along line 11—11 of FIG. 10 and similar to FIG. 9, but showing the drive arm coupled for rotation with a drive shaft, whereas FIG. 9 discloses the drive arm uncoupled from the drive shaft;

FIG. 12 is a vertical sectional view taken along line 12—12 of FIG. 8; and FIG. 13 is an enlarged detailed view showing a portion of the mechanism for coupling and uncoupling the drive arm to a drive shaft and taken substantially along line 13—13 of FIG. 12".

DETAILED DESCRIPTION OF PRACTICAL EMBODIMENTS

Referring now in more detail and by reference characters to the drawings which illustrate practical embodiments of the present invention, A designates a gate opening and closing apparatus operable in connection with a gate 10 hingedly mounted on a hinge post 12 so that it is movable with respect to a stationary structure 14, such as a stationary post.

In the embodiment as illustrated, the gate 10 comprises top and bottom longitudinally extending rails 16 and 18 connected at their ends by vertically extending rails 20 and 22, the rail 20 defining a freely movable side of the gate, and the rail 22 defining another side, which is hinged by means of hinges (not shown). Further, the gate 10 is provided with a plurality of vertically extending longitudinally spaced apart rails 26 in a conventional manner.

In essence, gates of this type are typically used in security apartment buildings and similar commercial establishments and dwelling structures. The access opening permits passage of either people or vehicles, and the gate can be shifted from the closed to the opened position for such access. Generally, many of the commercially available prior art gate opening and closing assemblies operate on the basis of a radio frequency receiver-transmitter system, such that the party desiring to open the gate will actuate the transmitter to generate a signal which, in turn, causes the receiver to energize a motor for shifting the gate 10. In essence, transmitter-receiver system operates as a switch and, in this respect, the present invention can be used in the absence of a conventional radio frequency operated transmitter-receiver system. Thus, for example, a simple key operated switch or the like could be used.

As used herein, the term "gate" is used in its generic sense to include doors and like structures, and essentially constitutes any movable framework or structure which controls the entrance or exit through an access opening to provide a passageway The gate opening and closing apparatus A can be mounted in any convenient location with respect to the gate 10. For example, the gate opening and closing apparatus could be located on the ground in proximate relation to the gate and particularly near the hinged side thereof. In like manner, the apparatus could be mounted on the wall, or for that matter, a ceiling and have the drive arm thereof connected to the gate by means of lever arms. For this purpose, the lever arm construction, as illustrated and described in my copending patent application Ser. No. 126,315 filed Mar. 3, 1980 could be used with the mechanism of the present invention, particularly as illustrated, and as illustrated and described hereinafter in more detail.

The gate opening and closing apparatus A generally comprises an outer housing 30, with flange means 28 on the housing for attachment to a wall or ceiling or other stationary structure in which the apparatus A would be located. Mounted within the housing 30 is a suitable motive means, such as an electric motor 32. In this case, the electric motor 32 may be operated off of suitable household electrical current such as 110 volt AC electrical power. The electric motor 32 is designed to cause rotation of a drive shaft 34 through a drive train 36 as hereinafter described in more detail. The drive shaft 34 extends outwardly of the housing 30, and provided for coupling to the outer end of the drive shaft 34 is a drive arm mechanism or so-called "drive arm" 38. The drive arm 38 is adapted to be rotable with the drive shaft 34 when coupled thereto, although it can be uncoupled with respect to the drive shaft 34 and rotated independently thereof about the drive shaft 34 and in a manner to be hereinafter described in more detail.

The drive arm 38 may be suitably connected to the gate 10 by one or more lever arms, in the manner as illustrated in FIG. 1, for example. In this particular arrangement, a shiftable lever arm 40 is connected to the drive arm mechanism 38 and is also pivotally connected to a second lever arm 42 by means of a pivotal connection or so-called "elbow" 44. The other end of the lever arm 42 is thereupon pivotally connected to the gate 10 by any conventional construction, as for example, a bracket 46 which is welded to or otherwise secured to the gate 10, in the manner as illustrated. Preferably, the lever arm 42 is pivotally mounted to the bracket 46 or other portion of the gate 10 through a pivot mounting 48.

The lever arm 42 could be pivotally mounted to the gate through a mounting block comprised of a housing having an internally threaded bore to receive one end of the lever arm 42 and which is physically retained therein by means of a retaining screw. In this way, the overall length of the lever arms can be effectively adjusted by threadedly positioning the lever arm 42 in the bore and retaining same with the screws. This allows the two lever arms 40 and 42 to be adjusted so that they can be perfectly aligned to provide a "dead center" lock arrangement, if desired to aid in preventing unauthorized opening. In this respect a means (not shown) could be employed to prevent the arms from being locked (stalling) in a dead center position; e.g. where the two arms are located so that one is disposed over the other (marginally aligned). This last named means would release any locking arrangement when it is desired to authorizedly move the gate.

The drive train 36 generally comprises a pulley or drive sprocket 50 which is mounted on an output shaft 52 of the motor 32. The drive pulley 50, in turn, rotates a similar drive pulley or sprocket 54, of larger diameter, through a drive belt or drive chain 56, in the manner as illustrated in FIG. 3 of the drawings.

The drive pulley 54 is mounted on an intermediate shaft 58 located within the housing 30 as more fully illustrated in FIG. 3 of the drawings. The intermediate shaft 58 is journaled within a pair of spaced-apart roller bearings 60, as also illustrated in FIG. 3. In addition, the drive pulley 54 is actually coupled to the intermediate shaft 58 through a clutch 62 which, in this case, is comprised of a pair of clutch plates 64 and 66, in the manner as illustrated. The clutch 62 will allow for some small degree of slippage, although it will not allow someone to unauthorizedly open the gate as hereinafter described in more detail.

Mounted on and being rotatable with the intermediate shaft 58, reference being made to FIG. 3, is a worm 68 which is located in meshing engagement with a worm gear 70 mounted on the drive shaft 34. Thus, as the motive means, such as the electric motor 32 is energized, the rotation of the intermediate shaft 58 through the various drive pulleys and drive belt, as mentioned, will cause rotation of the worm 68. As this occurs, the worm gear 70 will cause rotation of the drive shaft 34.

In connection with the above outlined construction, it should be understood that the speed of rotation of the drive shaft 34 can be regulated by properly determining the sizes of the various gears and worm located within the drive housing 30.

The apparatus A also includes a counting device 72 which is designed to count the number of rotations of the intermediate shaft or for that matter, the drive shaft 34 in determining the amount of movement of the gate between the opened and closed positions or between the closed and open positions. The counting mechanism 72 is preferably an electrical type, and is preferably operable in connection with an electronic control mechanism 74 such as a solid-state circuit board.

The counting mechanism 72, in the illustrated embodiment, comprises a disc 76 which, in this case, is mounted on the intermediate shaft 58 although it could be mounted on the drive shaft 34. The disc 76 is operable in connection with a light counter mechanism 78, the latter being mounted on a base plate 80 and located in proximity to the disc 76. In this case, the disc 76 is provided with a plurality of openings 82 or similar light passage areas. A photocell 84 and a source of light 86 spaced apart on opposite sides of the disc 76 will cause the various openings 82 to permit generation of digital counts representing the number of rotations of the shaft 58. Thus, with four such light passage areas, as illustrated, detection of four bits or digital signals will represent one complete rotation of the intermediate shaft 58.

The solid-state circuit is designed to count the number of rotations of the intermediate shaft and hence the drive shaft 34 for the gate to move from the open position to the closed position. Thereafter, the solid-state control 74 can thereupon control the time for energization of the motive means 32 through the number of rotations of the shaft 58. Thus, after the count has been determined for shifting the gate from the closed position to the open position, and when it is desired to shift the gate again from the open position back to the closed position, the counter 72 in conjunction with the control circuit 74 will count the number of rotations of the intermediate shaft 58. When this number of rotations equals that obtained in opening the gate, the gate has thereupon reached the closed position, and the control circuit 74 will automatically de-energize the motor 32. In this way, it is possible to avoid the hard slam of the gate against a stationary structure, such as the stationary post, and further to avoid the impact on the motor and various other components of the drive train.

The solid state circuit board would contain these components necessary and in the desired arrangement (properly programmed as may be required) to perform these rudimentary functions of counting pulses and to permit energization of a motive means to thereby permit movement of a gate for a desired distance. Design of a circuit board for the functions mentioned above is obvious to the skilled artisan.

FIGS. 5 through 13 more fully illustrate the drive arm 38 forming part of the apparatus A. The drive arm 38 comprises an outer casing 90 which is essentially somewhat trapezoidal in top plan view, as illustrated in FIG. 6. In this embodiment, the casing 90 is bifrucated at one end to provide a pair of spaced apart legs 92 and 94 forming an elongate slot 96 therein. The slot 96 is designed to receive one end of one of the lever arms, as for example, the lever arm 40. The lever arm 40 could be mounted within the elongate slot 96 in any conventional manner and would therefore be rotatable with the rotation of the drive arm 38. Thereafter, a cover plate 98 is disposed over the elongate slot 96 and secured thereto by means of a plurality of screws 100 or similar mechanical fasteners. The cover plate 98 when secured over the slot 96 by the screws 100 is sufficient to retentively hold the lever arm 40 within the drive arm 38.

The right-hand end of the casing 90 is provided with a vertically extending bore 102 which is sized to receive a sleeve 104, the latter of which is capable of being rotatable within the bore 102. The sleeve 104 is similarly provided with a central aperture 33 sized to receive the drive shaft 34, in the manner as illustrated in FIGS. 8–11 of the drawings. In this case, it can be observed that the drive shaft 34 would be keyed to or otherwise rigidly secured to the sleeve 104 so as to be rotatable therewith as for example by a key 105 extending in a keyway 107 in the sleeve 104 and an aligned keyway in the drive shaft 34. In FIGS. 8–11 the drive arm 38 has been shown disconnected from the drive shaft 34 and FIG. 13 shows the drive arm 38 connected to the drive shaft 34.

The drive shaft 34 is coupled to the sleeve 104 and hence to the drive arm 38 through the shaft coupling means including at least the sleeve 104. A disconnect means, and preferably a manually operable disconnect means is associated with the shaft coupling to permit the shaft to rotate independently of the drive arm. This disconnect means comprises a manually operable disconnect arm 106 which extends through a bore in the casing 90 and controls the position of a locking element 108.

By reference to FIGS. 9 and 11, it can be observed that the locking element 108 presently exists in the form of a disc and is ecentrically mounted on a portion of the arm 106 located within the casing 90. The locking element 108 can be located within a recess 110 formed within the casing when in the uncoupled position, that is where the drive shaft 34 is not coupled to the drive arm 38, as shown in FIG. 9. Moreover, the arm 106 can be turned manually so that the locking element 108 can be shifted to a position where it lies partially within the recess 110 and partially within a notch 112 formed within the sleeve 104. Inasmuch as the sleeve 104 is rotatable with the drive shaft 34, when the locking element 108 is located within the notch 112, in the manner as illustrated in FIG. 10, then the drive shaft 34 will also cause rotation of the drive arm 38. In like manner, when the disconnect arm 106 is shifted to the position as illustrated in FIGS. 8 and 9, the locking element 108 will be located essentially entirely within the recess 110 so that the drive shaft 34 is uncoupled with respect to the drive arm 38. In other words, the sleeve 104, and the drive shaft 34 coupled to the sleeve 104, may be rotatable in the bore 102 when the locking element 108 is in the unlocked position as shown in FIG. 13, and hence are rotatable independently of the drive arm 38. When the locking element 108 is shifted to the locked position as shown in FIG. 10, it will engage the notch 112, and therefore the sleeve 104 and hence the drive shaft 34 becomes coupled to the drive arm 38 to cause rotation of the drive arm 38 when the drive shaft is powered for rotation.

One portion of the manually operable disconnect arm 106 located within the bore of the casing is provided with opposed flat surfaces 114 and 116, in the manner as illustrated in FIGS. 10, 12 and 13. The flat surfaces 114 and 116 essentially define first and second end positions for the manually operable disconnect arm 106. In this case, a plug 118 is spring biased by means of a compression spring 120 against either one of the flat surfaces 114 or 116. Thus, when one wishes to turn the manually operable disconnect arm 106, the plug 118 will be biased rearwardly against the action of compression spring 120 so that the lever arm may turn, and in this case, to the opposite flat face 114 or 116. In like manner, the lever arm can be turned again to the initial position so that the plug 118 is in contact with the initial flat surface 114 and 116. Moreover, it can be observed by reference to FIG. 12 or 13 that this assembly is retained within a bore 122 formed within the casing 90 by means of a locking screw 124.

The end of the drive shaft 34 and the sleeve 104 may be suitably covered by means of another cover plate 126 secured to the casing by means of screws cr bolts 128. Again, this cover plate 126 is desirable in order to provide access to the sleeve 104 or to the drive shaft 34 for purposes of repair, lubrication, or the like.

The manually operable disconnect means along with the shaft coupling means provides a convenient way to override the apparatus in the event of an emergency condition, such as a power failure. Thus, the manually operable disconnect arm 106 could be locked into position by means of a conventional padlock (not shown). For this purpose, a recess portion 130 is provided in one of the legs 94 along with a post 132. The padlock could be inserted around the post 132 and engage the manually operable disconnect arm 106 in order to prevent unauthorized movement thereof.

It can be observed that when the motor 32 is energized in the manner as previously described, it will cause rotation of the worm gear 70 along with the drive shaft 34. However, in the event of a power failure or other failure of the motor 32, when it is necessary to open the gate, the person having a key to the padlock could open the padlock and merely shift the manually operable disconnect arm 106 to the opposite position as illustrated in FIGS. 8 and 9. As this occurs, the drive arm 38 can be rotated about the drive shaft 34 independently thereof in order to permit manual opening and closing of the gate.

It can also be observed that inasmuch that the present apparatus uses a worm and worm gear combination, that one cannot unauthorizedly attempt to rotate the motor 32 in reverse by manually turning the drive arm 38. The worm and worm gear in the arrangement as illustrated provide a positive locking action such that one could not unauthorizedly attempt to open the gate by turning the drive arm 38 without first uncoupling the drive shaft from the drive arm 38 in the authorized manner.

The various components forming part of the drive housing as well as the other portions of the apparatus A are preferably formed of a structural material such as iron, aluminum, or the like. However, it should be understood that other structural materials, including for example, various plastics, could be used. Furthermore, reinforced plastics such as epoxy-resin composites could be used in the formation of many of the components forming part of the apparatus A.

Thus, there has been illustrated and described a unique and novel improved gate opening and closing apparatus and method which is capable of moving a gate to and from closed and opened positions and in response to energization of a motive means and where a manually operable override means can permit opening and closing of the gate without the motive means. The invention therefore fulfills all of the objects and advantages sought therefor. It should be understood that many changes, modifications, variations and other uses and applications will become apparent to those skilled in the art after considering this specification and the accompanying drawings. Therefore, any and all such changes, modifications, variaions, and other uses and applications which do not depart from the spirit and scope of the invention are deemed to be covered by the invention which is limited only by the following claims.

Having thus described my invention, what I desire to claim and secure by Letters Patent is:

1. An apparatus for swinging a gate in an arcuate path from a closed position with respect to an access opening to an opened position and from the opened position to the closed position, said apparatus comprising:

(a) housing means, (b) motive means in said housing means, (c) a drive shaft extending from said housing means and being rotatable by said motive means in both clockwise and counter-clockwise directions during normal operation, (d) a drive arm respectively connected to said drive shaft and being rotatable thereby in both clockwise and counter-clockwise direction during normal operation, (e) a lever arm means comprising:

(1) a first lever arm operatively coupled to said drive arm, and capable of being driven through an arcuate path upon operation of said motive means, and (2) a second lever arm pivotally coupled to said first lever arm by a pivotal connection, said second lever arm also being operatively connected to said gate and moving through a somewaht arcuate path upon movement of said first lever arm, (f) means associated with said drive arm to permit said first lever arm to be coupled thereto for arcuate movement with said drive arm and to permit coupling of the second lever arm to a gate for swinging same to an open position and to a closed position, (g) shaft coupling means associated with said drive arm for coupling said drive arm to said drive shaft so that said drive arm is rotatable with said drive shaft when the motive means is operated, and (h) disconnect means associated with said drive arm and being operatively connected to said shaft coupling means for disengaging said shaft coupling means from said drive arm to permit said drive arm to rotate independently of said drive shaft.

2. The apparatus of claim 1 further characterized in that said apparatus comprises a clutch operatively interposed between said motive means and said drive shaft to permit slipage between said drive shaft and motive means.

3. The apparatus of claim 2 further characterized in that said motive means is an electrically operable motor.

4. The apparatus of claim 1 further characterized in that said first and second lever arms each have one of their axis parallel in space to a similar axis of the other of said lever arms.

5. The apparatus of claim 1 further characterized in that said disconnect means is manually operable disconnect means.

6. The apparatus of claim 1 further characterized in that said gate is swingable between the open and closed position across the access opening on a hinge mechanism.

7. The apparatus of claim 1 further characterized in that said shaft coupling means comprises a bore in said drive arm and a hollow sleeve locatable in said bore, said sleeve having an opening receiving said drive shaft for causing said sleeve and drive arm to rotate with said drive shaft.

8. The apparatus of claim 7 further characterized in that said disconnect means is manually operable and comprises a locking element adapted to be manually shifted between a slot in the drive arm and the sleeve to lock one another together to permit rotation together, said locking element being adapted to be manually shifted out of the slot in the sleeve to permit the drive arm to rotate independently of the drive shaft.

9. The apparatus of claim 8 further characterized that said arm has an enlarged recess adapted to receive said first lever arm.

10. An apparatus for shifting a gate hingedly mounted at one of its sides so as to be swingable from a closed position with respect to an access opening to an opened position and from the opened position back to the closed position, said apparatus comprising:

(a) housing means,
(b) motive means in said housing means,
(c) a drive shaft extending from said housing means and being rotatable by said motive means,
(d) coupling means operatively connecting said drive shaft and said motive means, said coupling means comprising an intermediate shaft,
(e) a worm gear mounted on said drive shaft for rotation therewith,
(f) a worm mounted on said intermediate shaft for rotation therewith and being disposed in meshing engagement with said worm gear, such that a rotational force exerted on said drive shaft will not cause unauthorized rotation of said intermediate shaft and said motive means and thereby prevent unauthorized swinging movement of said gate to open said gate, and
(g) means on said drive shaft for operative connection to a gate for opening and closing same in response to energization of said motive means.

11. The apparatus of claim 10 further characterized in that a clutch is associated with said intermediate shaft and interposed between the motive means and the combination of worm and worm gear.

12. The apparatus of claim 11 further characterized in that said motive means is an electrically operable motor.

13. The apparatus of claim 10 further characterized in that the means on the drive shaft for operative connection to a gate is a drive arm which is rotatable with the drive shaft.

14. The apparatus of claim 13 further characterized in that shaft coupling means is associated with said drive arm for coupling said drive arm to said drive shaft so that said drive arm is rotatable with said drive shaft when the motive means is operated, and manually operable disconnect means is associated with said drive arm and is operatively connected to said shaft coupling means for disengaging said shaft coupling means from said drive arm to permit said drive arm to rotate independently of said drive shaft.

15. The apparatus of claim 14 further characterized in that means is associated with said drive arm to permit the lever arm means to be coupled thereto and to be operatively coupled to a gate for shifting same to an open position and to a closed position.

16. The apparatus of claim 10 further characterized in that said gate is swingable in an arcuate path such that said apparatus moves said gate across said access opening.

17. The apparatus of claim 14 further characterized in that said shaft coupling means comprises a bore in said drive arm and a sleeve locatable in said bore, said sleeve having an opening receiving said drive shaft for causing said sleeve and drive arm to rotate with said drive shaft.

18. The apparatus of claim 17 further characterized in that said disconnect means is manually operable and comprises a locking element adapted to be manually shifted between a slot in the drive arm and the sleeve to lock one another together to permit rotation together, said locking element being adapted to be manually shifted out of the slot in the sleeve to permit the drive arm to rotate independently of the drive shaft.

19. A drive arm assembly for use in shifting a gate between an open position and a closed position with respect to an access opening and which is operable by a powered rotatable shaft; said drive arm assembly comprising:

(a) an outer casing having an opening therein,
(b) a sleeve disposed in the opening of said casing and having a recessed portion therein, said sleeve being coupled to and rotatable with said powered rotatable shaft,
(c) a locking element in said casing and being shiftable from a coupled position where said element is disposed in said recessed portion and locks said sleeve and shaft to said drive arm casing to an uncoupled position where said element is located out of said recessed portion and where said sleeve and shaft are moveable independently of said drive arm casing, and
(d) a manually actuable handle means operatively connected to said locking element and extending outwardly from said casing to shift said locking element from the position in said recessed portion to the position out of said recessed portion.

20. The apparatus of claim 19 further characterized in that means are operatively associated with said handle means to define stop locations such that the coupled position is represented by one stop location and the uncoupled position is represented by the other stop location.

21. The apparatus of claim 19 further characterized in that a drive mechanism is used with said drive arm assembly, said drive mechanism comprising:

(a) housing means,
(b) motive means in said housing means,
(c) a drive shaft extending from said housing means and being operable by said motive means,
(d) coupling means operatively connecting said drive shaft and said motive means, said couling means comprising an intermediate shaft,
(e) a worm gear operatively mounted on said drive shaft,
(f) a worm on said intermediate shaft in meshing engagement with said worm gear, such that a rotational force exerted on said drive shaft will not cause unauthorized rotation of said intermediate shaft and said motive means to permit unauthorized opening of said gate, and
(g) means on said drive shaft for operative connection to a gate for opening and closing same in response to energization of said motive means.

22. The apparatus of claim 21 further characterized in that a clutch is associated with said intermediate shaft and interposed between the motive means and the combination of worm and worm gear.

23. An apparatus for shifting a gate from a closed position with respect to an access opening to an opened position and from the opened position to the closed position, said apparatus comprising:

(a) housing means,
(b) motive means in said housing means,
(c) a drive shaft extending from said housing means and being operable by said motive means,
(d) a drive arm operatively connected to said drive shaft and being rotatable thereby,
(e) means associated with said drive arm to permit a lever arm means to be coupled thereto and to be operatively coupled to a gate for shifting same to an open position and to a closed position,
(f) shaft coupling means associated with said drive arm for coupling said drive arm to said drive shaft so that said drive arm is rotatable with said drive shaft when the motive means is operated,
(g) a source of light,
(h) a light sensitive transducer capable of generating an electrical pulse in response to incidence of light thereon,
(i) an interruption member capable of being rotatable with said drive shaft or shaft compling means and located between said source of light and said transducer to periodically interrupt the light incident on the transducer and thereby generate an electrical pulse for each interruption, and
(j) control means for counting the number of pulses and thereby determining the amount of drive shaft rotations and hence the amount of movement of the gate between the opened and closed positions in response to the number of rotations of the drive shaft.

24. The apparatus of claim 23 further characterized in that said interruptor member comprises a disc associated with and rotatable with said drive shaft and having at least one light passage area therein, said transducer is a photocell, and said light source and photocell being located with respect to said light passage area to count the rotations of said drive shaft.

25. The apparatus of claim 24 further characterized in that said control means is a solid state circuit control means.

26. The apparatus of claim 23 further characterized in that manually operable means is associated with said drive arm and is operatively connected to said shaft coupling means for disengaging said shaft coupling means from said drive arm to permit said drive arm to rotate independently of said drive shaft.

27. A method of shifting a gate from a closed position to an open position and from the open position to the closed position with respect to an access opening, said method comprising:

(a) energizing a motive means,
(b) causing rotation of a drive shaft in response to energization of said motive means,
(c) causing a drive arm connected to said drive shaft to shift a gate in response to rotation of said drive shaft,
(d) shifting a manually actuable arm on said drive arm to enable said arm to be rotated independently of said drive shaft about said drive shaft to thereby permit manual shifting of said gate,
(e) periodically interrupting light incident on a light transducer and thereby generating an electrical pulse for each interruption,
(f) counting the number of pulses and thereby determining the amount of drive shaft rotations and hence the amount of movement of the gate between the opened and closed positions in response to the number of rotations of the drive shaft, and
(g) controlling the amount of movement of said gate in response to the number of rotations of said drive shaft.

28. An apparatus for shifting a moveable member through a controlled distance from a closed position with respect to an access opening to an opened position and from the opened position to the closed position, said apparatus comprising:

(a) housing means,
(b) motive means associated with said housing means,
(c) drive means operable by said motive means and being coupled to said moveable member for moving same between the opened and closed positions,
(d) a source of light,
(e) a light sensitive transducer capable of generating an electrical pulse in response to incidence of light thereon;
(f) a counting element moveable by said drive means and which counting element moves in response to operation of the drive means between the source of light and with the movement of said moveable member from the opened to the closed position or from the closed to the opened position said counting element periodically interrupting the light incident on the transducer and thereby generate an electrical pulse for each interruption, said counting element thereby generating counts representing amount of movement as it moves; and
(g) control means operatively associated with said counting element for initially determining the number of counts and hence amount of movement of said counting element and thereby determining the amount of movement of said moveable member from the closed position to the opened position or from the opened position to the closed position, said control means being coupled to said motive means such that the motive means is operable to shift the moveable member from the opened position to the closed position or from the closed position to the opened position for the desired number of counts on subsequent occasions in accordance with the initially determined counts and initially determined amount of movement.

29. The device of claim 28 further characterized in that said control means comprises an electronic control means.

30. The device of claim 28 further characterized in that said control means comprises an electronic control means including a solid state circuit board.

31. The device of claim 28 further characterized in that said counting element comprises a disc having a plurality of apertures therein and said source of light and transducer are located with respect to said apertures to generate signals when the apertures become aligned with the source of light.

32. An improvement in opening and closing apparatus used for shifting a moveable member from a closed position with respect to an access opening to an opened position and from the opened position to the closed position, and which apparatus includes a drive means for shifting said moveable member, said improvement comprising:

(a) a source of light, (b) a light sensitive transducer capable of generating an electrical pulse in response to incidence of light thereon, (c) an interruptor member capable of being rotatated by a powered drive means which moves said moveable member and which is located between said sources of light and said transducer to periodically interrupt the light incident on the transducer and thereby generate an electrical pulse representative of a count for each interruption, and (d) control means operatively associated with said transducer and the interruptor member moveable by said drive means for initially determining the number of counts generated by said interruptor member which is directly related to the amount of movement of said moveable member and thereby determining the amount of movement of said moveable member from the closed position to the opened position or from the opened position to the closed position, said control means being coupled to said drive means to thereafter control said drive means such that the drive means is operable to shift the moveable member from the opened position to the closed position or from the closed position to the opened position on subsequent occasions in accordance with the initially determined counts and hence the initially determined amount of movement.

33. The device of claim 32 further characterized in that said control means comprises an electronic control means.

34. The device of claim 32 further characterized in that said control means comprises an electronic control means including a solid state circuit board.

35. The device of claim 32 further characterized in that said interruptor member comprises a disc having a plurality of apertures therein and said source of light and transducer are located with respect to said apertures to generate signals when the apertures become aligned with the source of light.

36. A method of shifting a moveable member through a controlled distance from a closed position to an opened position and from the opened position to the closed position with respect to an access opening, said method comprising:

(a) energizing a motive means, (b) causing rotation of a drive member in response to energization of said motive means, (c) initially periodically interrupting light incident on a transducer.

(d) generating an electrical pulse for each interruption, (e) initially counting the pulses and determining the amount of movement of said drive member and thereby determining the amount of movement of said moveable member from the closed position to the opened position or from the opened position to the closed position, and (f) thereafter controlling the motive means such that the motive means is operable to shift the moveable member from the opened position to the closed position or from the closed position to the opened positioned on subsequent occasions in accordance with the initially determined amount of movement.

37. The drive arm forming part of the apparatus of claim 1 for use in shifting a gate between an open position and a closed position with respect to an access opening, said drive arm further comprising:

(a) an outer casing having an opening therein, (b) a sleeve disposed in the opening of said casing and having a recessed portion therein, (c) a locking element in said casing and being shiftable from a coupled position where said element is disposed in said recessed portion and locks said sleeve to said drive arm to an uncoupled position where said element is located out of said recessed portion and where said sleeve and drive shaft are moveable independently of said drive arm, and (d) a manually actuable handle means operatively connected to said locking element and extending outwardly from said casing to shift said locking element from the position in said recessed portion to the position out of said recessed portion.

38. The apparatus of claim 37 further characterized in that means are operatively associated with said handle means to define stop locations such that the coupled position is represented by one stop location and the uncoupled position is represented by the other stop location.

39. The apparatus of claim 37 further characterized in that said motive means comprises:

(a) housing means, (b) motive means in said housing means, (c) said drive shaft extending from said housing means and operable by said motive means, (d) said shaft coupling which connects said drive shaft and said motive means comprising an intermediate shaft, (e) a worm gear operatively mounted on said drive shaft, and (f) a worm on said intermediate shaft in meshing engagement with said worm gear, such that a rotational force exerted on said drive shaft will not cause unauthorized rotation of said intermediate shaft and said motive means to permit unauthorized opening of said gate.

40. The apparatus of claim 39 further characterized in that a clutch is associated with said intermediate shaft and interposed between the motive means and the combination of worm and worm gear.

41. An apparatus for shifting a gate from a closed position with respect to an access opening to an opened position and from the opened position to the closed position, said apparatus comprising:

(a) housing means, (b) motive means in said housing means, (c) a drive shaft extending from said housing means and being operable by said motive means, (d) a drive arm operatively connected to said drive shaft and being rotatable thereby, (e) means associated with said drive arm to permit a lever arm means to be coupled thereto and to be operatively coupled to a gate for shifting same to an open position and to a closed position, (f) shaft coupling means associated with said drive arm for coupling said drive arm to said drive shaft so that said drive arm is rotatable with said drive shaft when the motive means is operated, said shaft coupling means comprising:

(1) a casing forming part of said drive arm and having an internal bore therein axially aligned with said drive shaft, (2) a sleeve located in said bore and being rotatable in said bore independently of said casing, and (g) disconnect means associated with said drive arm and being operatively connected to said shaft coupling means for operatively disengaging said shaft coupling means from said drive shaft to permit said drive arm to rotate independently of said drive shaft, said disconnect means comprising a locking element capable of being shifted from a first position where it is disposed in a slot in said sleeve thereby coupling said sleeve and drive shaft to said drive arm to a second position where it is out of said slot thereby permitting said sleeve to rotate independently of said drive arm.

42. The apparatus of claim 41 further characterized in that said gate is swingable in an arcuate path and that said apparatus moves said gate across said access opening.

43. The apparatus of claim 42 further characterized in that said lever arm means comprises:

(a) a first lever arm operatively coupled to said drive arm, and capable of being driven through an arcuate path upon operation of said motive means, and (b) a second lever arm pivotally coupled to said first lever arm by a pivotal connection, said second lever arm also being operatively connected to said gate and moving through a somewhat arcuate path upon movement of said first lever arm.

44. The apparatus of claim 42 further characterized in that said apparatus comprises a clutch operatively interposed between said motive means and said drive shaft to permit slipage between said drive shaft and motive means.

45. The apparatus of claim 42 further characterized in that said disconnect means is a manually operable disconnect means.

46. The apparatus of claim 43 further characterized in that said drive arm has an enlarged recess adapted to receive the first lever arm of said lever arm means.

* * * * *